US011089877B1

(12) United States Patent
Capra

(10) Patent No.: US 11,089,877 B1
(45) Date of Patent: Aug. 17, 2021

(54) CONVERTIBLE CUSHION SYSTEM

(71) Applicant: Kneezly LLC, Washington, DC (US)

(72) Inventor: Thomas Capra, Washington, DC (US)

(73) Assignee: Kneezly LLC, Washington, DC (US)

( * ) Notice: Subject to any disclaimer, the term of this patent is extended or adjusted under 35 U.S.C. 154(b) by 0 days.

(21) Appl. No.: 17/180,332

(22) Filed: Feb. 19, 2021

Related U.S. Application Data

(60) Provisional application No. 62/978,406, filed on Feb. 19, 2020.

(51) Int. Cl.
*A47C 16/00* (2006.01)
*A47C 7/38* (2006.01)
*A47G 9/10* (2006.01)

(52) U.S. Cl.
CPC ..... *A47C 16/00* (2013.01); *A47C 7/383* (2013.01); *A47G 2009/1018* (2013.01)

(58) Field of Classification Search
CPC .. A47C 16/00; A47C 7/383; A47G 2009/1018
See application file for complete search history.

(56) References Cited

U.S. PATENT DOCUMENTS

| | | | |
|---|---|---|---|
| 7,000,273 | B2 | 2/2006 | Rivera-Wienhold et al. |
| 9,648,959 | B2 | 5/2017 | Frydman |
| 10,021,957 | B1 | 7/2018 | Bryan |
| D913,010 | S | 3/2021 | Jheow |
| 2002/0045845 | A1 | 4/2002 | Kruttke |
| 2009/0000036 | A1 | 1/2009 | Littlehorn et al. |
| 2011/0078861 | A1 | 4/2011 | Colonello et al. |
| 2011/0119833 | A1* | 5/2011 | Clark ..... A47D 13/083 5/655 |
| 2013/0312192 | A1 | 11/2013 | Lee |
| 2014/0310877 | A1 | 10/2014 | Sternlight et al. |
| 2017/0071351 | A1 | 3/2017 | Krug |
| 2020/0093294 | A1 | 3/2020 | Ban |

FOREIGN PATENT DOCUMENTS

| | | | |
|---|---|---|---|
| JP | 3210138 | U | 4/2017 |
| KR | 1020130015324 | A | 2/2013 |
| WO | 2018226159 | A1 | 12/2018 |

OTHER PUBLICATIONS

PCT Application No. PCT/US21/18918 filed Feb. 19, 2021, Inventor: Thomas Capra.
International Search Report and Written Opinion dated May 6, 2021 cited in Application No. PCT/US21/18918, 10 pgs.

* cited by examiner

*Primary Examiner* — Fredrick C Conley
(74) *Attorney, Agent, or Firm* — Bekiares Eliezer LLP

(57) ABSTRACT

In one aspect, embodiments of the present disclosure relate to a convertible cushion system including a pillow portion configured to detachably couple with a retaining portion in an assembled state. The pillow portion generally includes a base pillow portion configured to releasably attach to a portion of the retaining portion; and the retaining portion includes a retaining cushion having first and second opposed ends and at least first and second opposed faces, at least one adjustable strap having first and second opposed ends, the at least one adjustable strap disposed on the first face of the retaining cushion and configured to secure the retaining cushion around a user, and a connecting mechanism for detachably connecting portions of the at least one adjustable strap to create a loop. Also provided herein are methods for making and using the disclosed devices and systems.

18 Claims, 10 Drawing Sheets

CONVERTIBLE CUSHION SYSTEM

RELATED APPLICATIONS

This application claims the benefit of priority to U.S. Application No. 62/978,406 filed Feb. 19, 2020, which is hereby incorporated by reference herein in its entirety.

It is intended that the above-referenced application may be applicable to the concepts and embodiments disclosed herein, even if such concepts and embodiments are disclosed in the referenced applications with different limitations and configurations and described using different examples and terminology.

FIELD OF DISCLOSURE

The present disclosure relates to devices and systems for cushioning, and more specifically, to convertible cushion systems and devices.

BACKGROUND

Public transportation such as trains, buses, or aircraft often provide passenger seats that face an encumbrance such as a seat back or a bulkhead. This arrangement can be uncomfortable for passengers if the space (i.e., "leg room") between the passenger seat and the encumbrance is not long enough for a passenger to sit without contacting the encumbrance with a part of their legs or feet. Such an arrangement may be particularly uncomfortable for passengers with longer legs than average passengers who may have difficulty keeping their knees substantially together. When a tall passenger opens their legs while seating, their legs may extend into an aisle area or an adjacent passenger. Accordingly, a portable, convertible and convenient cushioning device is needed. This need and other needs are satisfied by the various aspects of the present disclosure.

SUMMARY

In accordance with the purposes of the invention, as embodied and broadly described herein, the invention, in one aspect, relates to devices and systems for cushioning, such as, for example, to enhance comfort during travel. In another aspect, the present disclosure relates to a convertible cushion system comprising a pillow portion configured to detachably couple with a retaining portion in an assembled or compact state. In further aspects, the retaining portion comprises a retaining cushion, at least one strap portion, wherein the at least one strap portion is adjustable in length, a connecting mechanism or device configured to connect and disconnect portions of the at least one strap portion. In still further aspects, the connecting device is further configured to allow adjustment of the length of the at least one strap portion.

In another aspect, embodiments of the present disclosure relate to a convertible cushion system comprising: a pillow portion operative to connect to legs of a user, the pillow portion comprising: at least one surface; and a retaining portion operative to secure the cushion portion between legs of the user, the retaining portion comprising: a retaining cushion, a plurality of retaining straps operative to secure distal ends of the retaining cushion, at least one strap portion, wherein the at least one strap portion is adjustable in length, a connecting device configured to connect and disconnect portions of the strap portion, wherein the connecting device is further configured to adjust the length of the at least one strap portion. In further aspect, the system may include one or more securing mechanisms, such as, for example, a band or elastic strap, for securing one or both ends of the at least one adjustable strap to or against a face of the retaining cushion.

In another aspect, embodiments of the present disclosure relate to a method for converting a convertible cushion system from an assembled state, to a retaining state, the method comprising: providing a convertible cushion system comprising: providing a pillow portion, securing a retaining portion around the pillow portion comprising: connecting, via at least one strap portion and a connecting device, a retaining cushion around the pillow portion; disconnecting the retaining portion from the pillow portion; arranging the pillow portion between the legs such that a first base portion and a second base portion of the pillow portion contacts an inner portion of the legs; arranging the retaining portion around the pillow portion such that the retaining cushion contacts the pillow portion and the legs of the user; and connecting, via a connecting device, a first end of the at least one strap portion to a second end of the at least one strap portion to form a substantially continuous loop such that the legs of the user are secured in a desired position.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

BRIEF OVERVIEW

Figure 1:
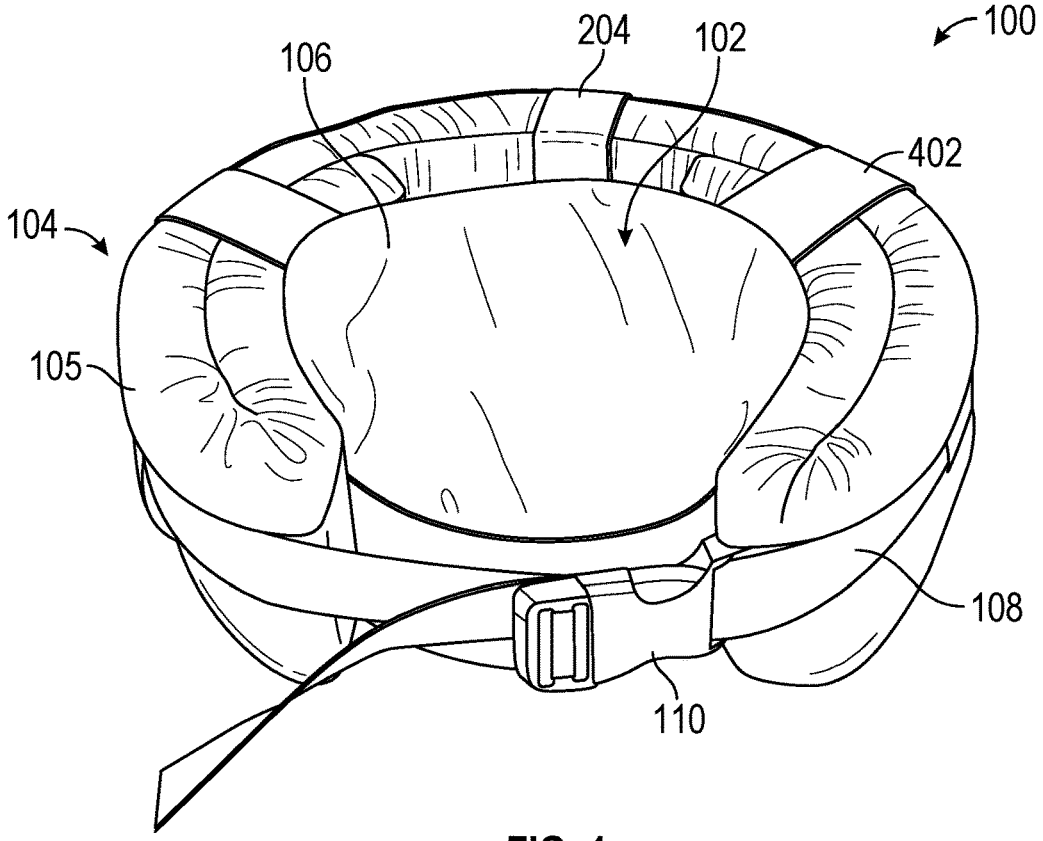
FIG. 1 illustrates a planar view of an embodiment of a convertible cushion system.

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

As discussed above, when passengers are sitting in a seat on a public transportation system, they often have limited leg room. Such a problem may be often seen on aircraft when a passenger in a seat falls asleep and loses control of their legs, which allows their legs to spread apart and crowd other passengers.

Another challenge for passengers in public transportation is when the space between the seat and an object in front of the seat (leg room), such as, a seat back or bulkhead is short or confining. Without enough legroom many passengers' legs or feet contact the object facing the seat, which may be painful and uncomfortable.

In this regard, one problem may include passenger legs that naturally want to swing out wide to either direction when seated—causing unwanted contact with other passengers' legs, or, if the individual is sitting in the isle, risk that one's knee will get hit by another passenger or food/beverage cart that is traveling down the aisle (especially while sleeping). Alternatively, trying to solve this problem naturally by using one's leg muscles to constantly "hold" one's legs closer together as to not swing too wide can be very uncomfortable—especially on very long flights.

In further aspects, another problem may include passenger legs that are so long that the knees hit up against the back of the seat in front of them. This causes significant discomfort. In various aspects, exemplary embodiments disclosed herein can include a wearable and adjustable travel accessory system with a retaining cushion detachably coupled with a base pillow having a foam core and fabric exterior (similar to that of a travel neck pillow) that solves the above problems as discussed below.

Embodiments directed to the problems described above can wrap around a user's thighs, just above the knees, and thus allows for the legs to be comfortably constrained, and only swing out to the sides based on the space allowed by the circumference of the retaining portion, like a padded belt. As with a belt, embodiments of the present invention can be adjusted to where one's thighs/knees can be (1) all the way together (both knees and inner thighs touching), (2) all the way together but with a pillow, such as a memory foam "round pillow", in between the thighs for substantially 360-degree comfort, and/or (3) at varying widths apart based on adjusting one or both of the adjusting mechanisms for length of the retaining cushion portion. Regarding the aforementioned item (2), the pillow may be secured to the underside of the retaining portion or cushion by a snap or hook and loop fastener or other attachment device.

In further aspects, the retaining portion may be used to wrap around the neck and/or forehead of a user. These embodiments can assist in providing head and/or neck support when a user is leaning and/or resting against another surface.

Embodiments of the retaining portion or retaining cushion can be pushed down to where it is covering the actual tops of the knees (or just below the knees) to provide a cushion between the knees and the uncomfortable back of the seat in front. The functionality to comfortably "constrain" the thighs/knees from spreading to either side continues in this position as well.

While embodiments may be described in the context of traveling and/or transportation-related solutions, the present disclosure is not limited to these aspects, and may be used in any situation when securing one's legs and/or neck is desired, or when sitting down for any extended period of time.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

DETAILED DESCRIPTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise.

Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail. As used in the specification and in the claims, the term "comprising" can include the aspects "consisting of" and "consisting essentially of." In this specification and in the claims, which follow, reference will be made to a number of terms which shall be defined herein.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list". Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

As used herein, the terms "surface" and "face" mean the outermost layer or uppermost boundary of an object or element. Thus, for example, reference to a cube would include three-dimensional objects bounded by six square faces or surfaces.

Disclosed are the materials, components, parts, and/or elements to be used to manufacture the disclosed devices and systems of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result. Furthermore, the invention of present disclosure may be referred to herein as a device, apparatus, system, cushion, pillow, and methods for making and using the invention.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of a convertible cushion system, embodiments of the present disclosure are not limited to use only in this context.

In some public transportation vehicles such as, for example, aircraft, trains, and busses, the spacing (i.e., "leg room") between the seats and encumbrances facing the seat is too short to allow passengers to sit comfortably without touching the encumbrance with their knees, shins, or other parts of the legs or feet. The exemplary illustrated embodiments described herein includes a convertible cushion system that increases passenger comfort by allowing the user to use a cushion and strap arrangement to hold the legs of the passenger in a desired position. The device and system may also provide other comfort for a traveler by being used around the neck or the head to support the head, or to provide padding for the head to rest on a substantially firm surface.

In various aspects, the present disclosure provides a convertible, multi-part cushion system that can be assembled and disassembled. In a further aspect, the system may include a base pillow or pillow portion configured to detachably couple with a retaining portion or cushion in an assembled state. The base pillow portion comprises at least one face (which may also be referred to herein as a "surface"), for example, a top face, an opposed bottom face, and at least one side face connecting the top and bottom faces. The base pillow portion may be configured to releasably attach to a portion of the retaining portion. The retaining portion may include a retaining cushion having first and second opposed ends and at least one face or surface, for example, a first face and a second opposed face. In still further aspects, the retaining portion may further comprise at least one adjustable strap having first and second opposed ends, said adjustable strap being disposed on a face or surface of the retaining cushion and configured to secure the retaining cushion around an object or user, and a connecting mechanism for detachably connecting portions of the adjustable strap to create a loop.

According to various further aspects of the invention, the devices, systems, and methods of the present disclosure can comprise multiple configurations. FIGS. 1-16 illustrate non-limiting examples of embodiments of operating environments, mechanisms, and components for the disclosed devices and systems. Although the operating environments, mechanisms, and components are disclosed with specific functionality, it should be understood that functionality may be shared between mechanisms and/or components, with some functions split between mechanisms and/or components, while other functions duplicated by the mechanisms and/or components. Furthermore, the name of the mechanisms, parts and/or components should not be construed as limiting upon the functionality of the mechanisms, parts and/or components. Moreover, each stage in the claim language can be considered independently without the context of the other stages. Each stage may contain language defined in other portions of this specifications. Each stage disclosed for one mechanism, part and/or component may be mixed with the operational stages of another mechanism, part and/or component. Each stage can be claimed on its own and/or interchangeably with other stages of other mechanisms, parts and/or components.

FIG. 1 illustrates a planar view of an embodiment of a convertible cushion system 100 in accordance with the present invention. In FIG. 1, the convertible cushion system 100 is shown in a compact arrangement ("assembled state" or "compact state") that allows the convertible cushion system 100 to be used as a head pillow to rest a head of a user while traveling. For example, if the traveler desires to nap on the floor at the airport, or perhaps while on the plane, the user may place the convertible cushion system 100 on a tray table or other object to rest their head. The convertible cushion system 100 in this compact arrangement allows it to be carried, stowed, or stored in a convenient place. The convertible cushion system 100 includes a pillow portion 102 and a retaining portion 104. In various embodiments, in the compact or assembled arrangement, retaining portion 104 may be removably attached to pillow portion 102, where retaining portion is configured to be coupled around the side face of pillow portion using the adjustable strap and connecting device, as shown in FIG. 1.

In the illustrated embodiment, the pillow portion 102 includes a substantially cylindrical shaped base pillow or base pillow portion 106 having a top face, an opposed bottom face, and a circular side face connecting the top and bottom faces. Base pillow portion 106 includes a correspondingly shaped and dimensioned deformable cover portion and filling (not shown) such as, for example, foam, a memory foam, woven materials, synthetic stuffing materials or organic stuffing materials. In some embodiments, pillow portion 102 may comprise a plurality of base pillow portions, such as a first base portion, a second base portion, and/or a middle portion. To this end, the retaining portion may be configured to be coupled around the plurality of base pillow portions using the adjustable strap and connecting mechanism, thereby retaining each of the base pillow portions therein.

Retaining portion 104 generally includes retaining cushion 105, which has first and second opposed ends and first and second opposed faces, an adjustable strap portion 108, which has first and second opposed ends, strap portion 108 being disposed on the outer face of a retaining cushion 105 and configured to assist in securing retaining cushion 105 around pillow portion 102 or a user, such as user legs 202; and connecting mechanism or device 110 for detachably connecting opposed portions of adjustable strap portion 108 to create a loop. To this end, retaining portion 104 is arranged around the pillow portion 102 such that the inner face of retaining cushion 105 contacts the side face of base pillow portion 106 of the pillow portion 102. Strap portion 108 is adjustable in length to fit around objects having varying diameters. Connecting device 110 may include, for example, a buckle, hook and loop fasteners, or another suitable device, mechanism or arrangement to connect and disconnect portions of the strap portion 108. The connecting device 110 may be used to adjust the length of the strap portion 108 and to connect portions of the strap portion 108 to form a substantially continuous loop. The connecting device 110 may be opened or disconnected to disconnect the portions of the strap portion 108.

It is noted that retaining cushion 104 and/or pillow portion 102 may be made from a plurality of materials such as, but not limited to, the following: a memory foam, an inflatable material, a synthetic fiber, a polyester material, an antimicrobial material, a closed cell foam, a plurality of feathers/feather-like materials, and any suitable pillow and/or cushion-appropriate material.

It is further noted that the shape of retaining cushion 104 and/or pillow portion 102 may be made into and/or formed to a plurality of shapes such as, but not limited to, the following: substantially triangular, substantially rectangular, substantially cylindrical, substantially spherical, substantially diamond-shaped, substantially elliptical-shaped, substantially conical, amorphous and/or any combination of the aforementioned shapes. In some embodiments, pillow portion 102 and/or retaining cushion 104 may further be configured to be hollow and/or comprise at least one aperture disposed at any part of pillow portion 102 and/or retaining cushion 104.

It is further noted that when describing and/or discussing retaining cushion 104 and/or pillow portion 102, "face," "surface," and iterations thereof (e.g., "at least one surface," "a first face," a second face," "a third face") may be used interchangeably.

Figure 2:
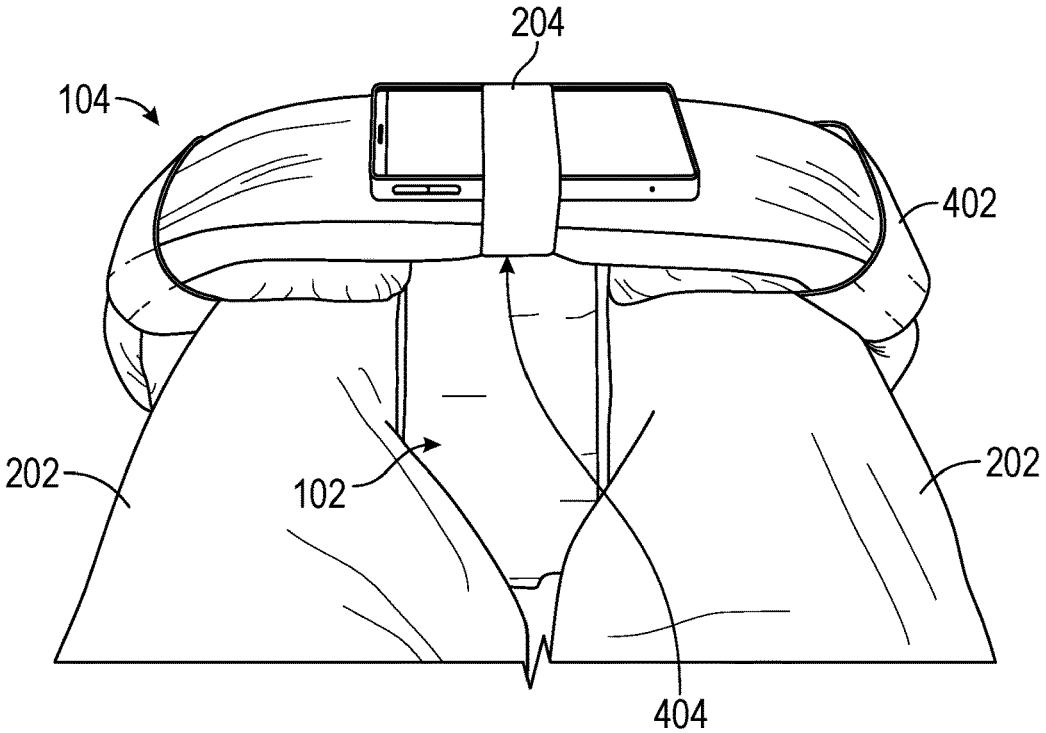
FIG. 2 illustrates a planar view of the convertible cushion system arranged on the legs of a user.

FIG. 2 illustrates a planar view of an alternative arrangement of the convertible cushion system 100 arranged on the legs 202 of a user, i.e., in a leg retaining state. In this regard, the retaining portion 104 is arranged about the legs 202 and the strap portion 108 is secured by the connecting device 110 to form a continuous loop around the legs 202.

The pillow portion 102 as arranged between the legs 202 is rotated 90 degrees relative to the orientation in the compact arrangement such that the top and bottom faces of base pillow portion 106 contacts the inner portions of the legs 202. The pillow portion 102 in the illustrated embodiment may provide cushioning between the legs, and the retaining portion 104 may impede the legs from moving apart.

In various embodiments, convertible cushion system 100 may include attachment region 404, which may include an attachment mechanism, for example, hook and loop fasteners, snaps, or buttons, configured for removably attaching pillow portion 102 to the retaining portion 104 in various orientations without the use of strap portion 108. Attachment region 404 may include two corresponding attachment regions, for example, a retaining portion attachment region 404*a* configured to operative to cooperatively engage a corresponding attachment region 404*b* disposed on a portion of the pillow portion 102.

As illustrated embodiment in FIG. 2, retaining portion 104 can include a securing mechanism, such as elastic strap 204, that may be used to retain items such as, for example a mobile phone and/or other portable devices.

Figure 3:
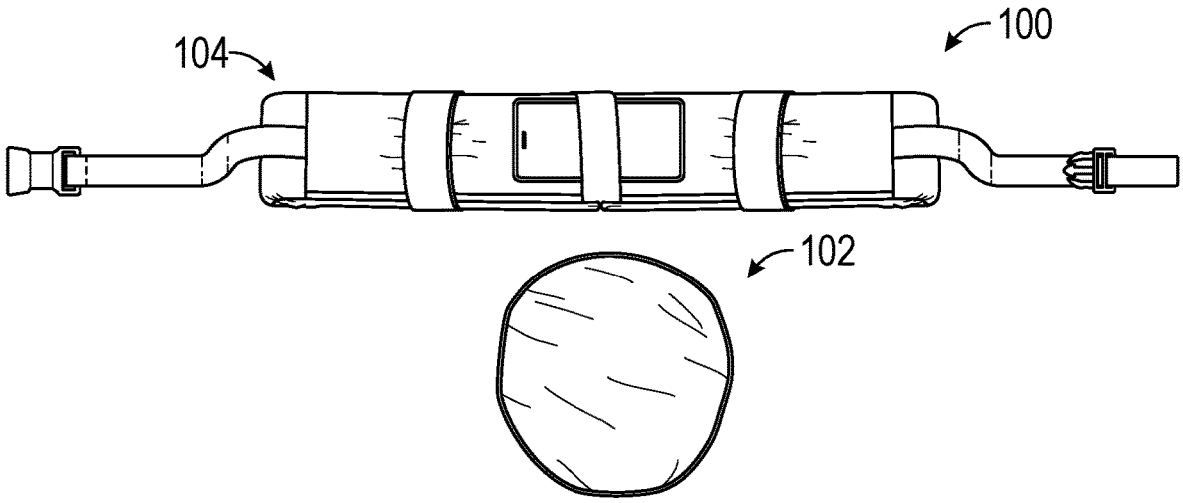
FIG. 3 illustrates a top view of the convertible cushion system.

FIG. 3 illustrates a top view of the convertible cushion system 100 in an unassembled state, where pillow portion 102 is separated from the retaining cushion 104.

Figure 4:
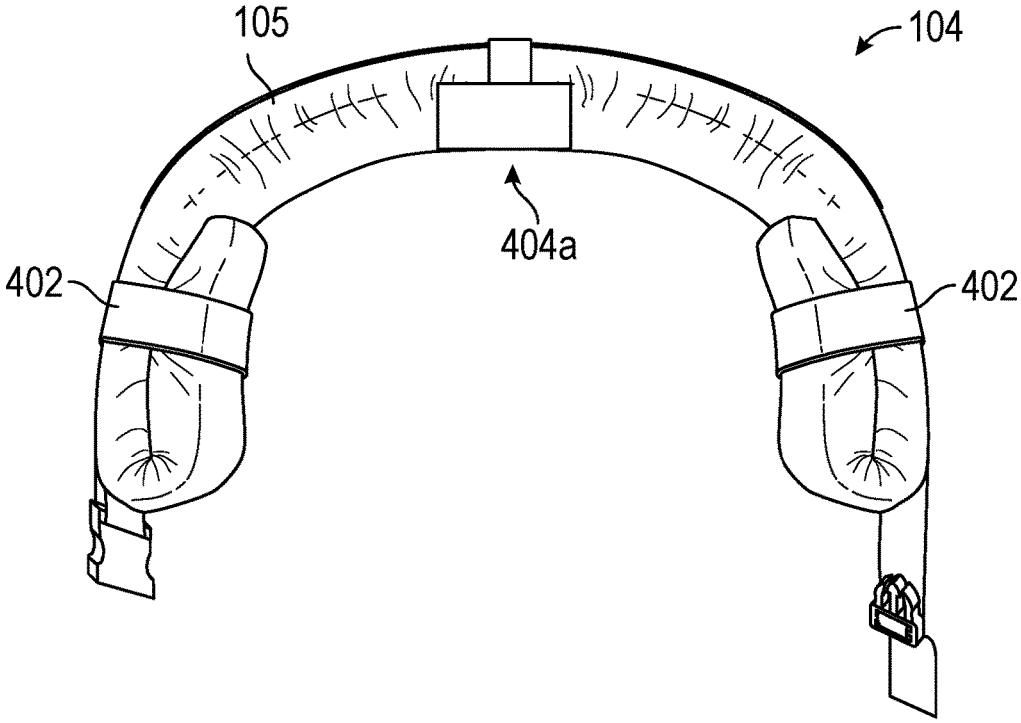
FIG. 4 illustrates a side view of the convertible cushion system.
Figure 5:
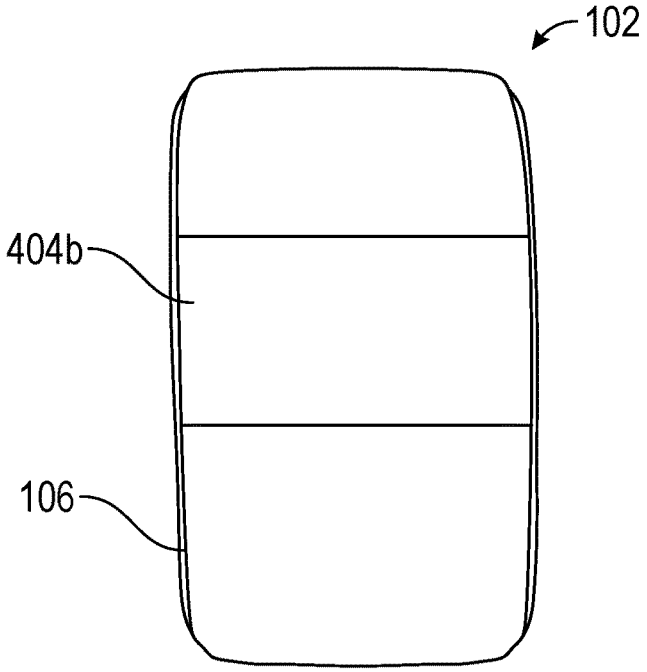
FIG. 5 illustrates a side view of the pillow portion.

FIG. 4 illustrates a side view of retaining portion 104 of the convertible cushion system 100. The retaining portion 104 may include retaining straps 402 that may use, for example, snaps, buttons, or hook and loop fasteners to secure distal ends of the retaining cushion 105 in a folded arrangement. Such an arrangement may allow users to adjust the length of the retaining cushion 105 to allow a comfortable arrangement for the user and accommodate objects of varying diameters. Retaining portion 104 can include attachment region 404*a* disposed on a bottom or underside face of retaining cushion 105, which may include an attachment mechanism, for example, a hook and loop fastener, buttons, or snaps. Attachment region 404*a* may be operative to engage a cooperative attachment mechanism on corresponding attachment region 404*b* disposed on a portion of the base pillow portion 106. In this regard, FIG. 5 illustrates a side view of the base pillow portion 106 with attachment region 404*b* that may be operative to engage and be retained by the attachment region 404*a*.

Figure 6:
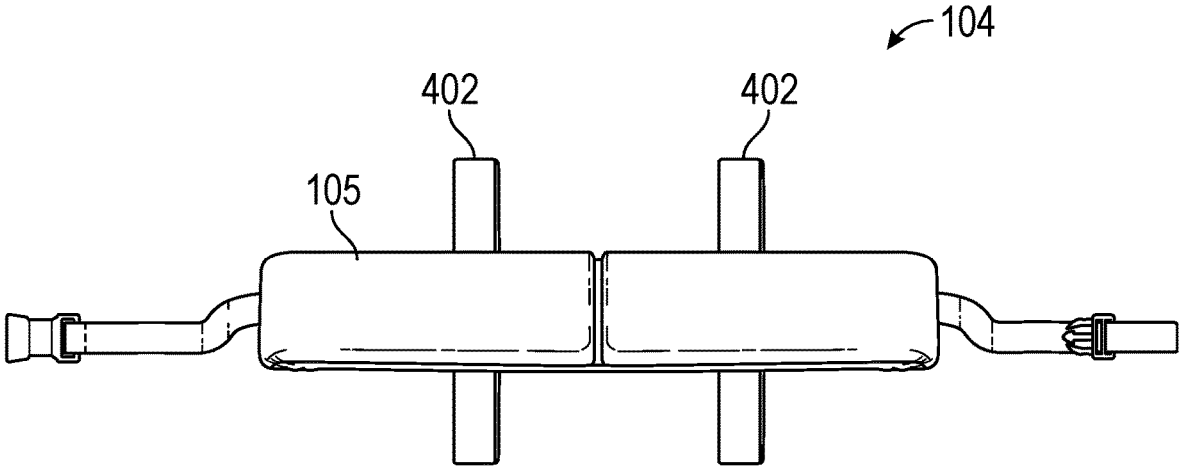
FIG. 6 illustrates a bottom view of the convertible cushion system.
Figure 7:
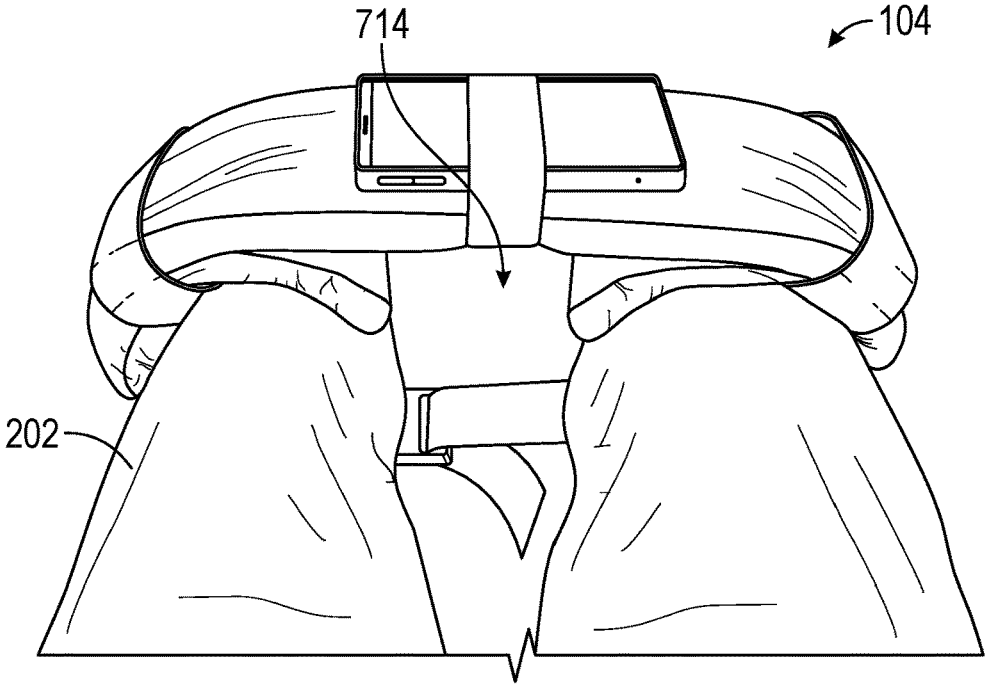
FIG. 7 illustrates a planar view of the convertible cushion system arranged about the legs of a user.
Figure 8:
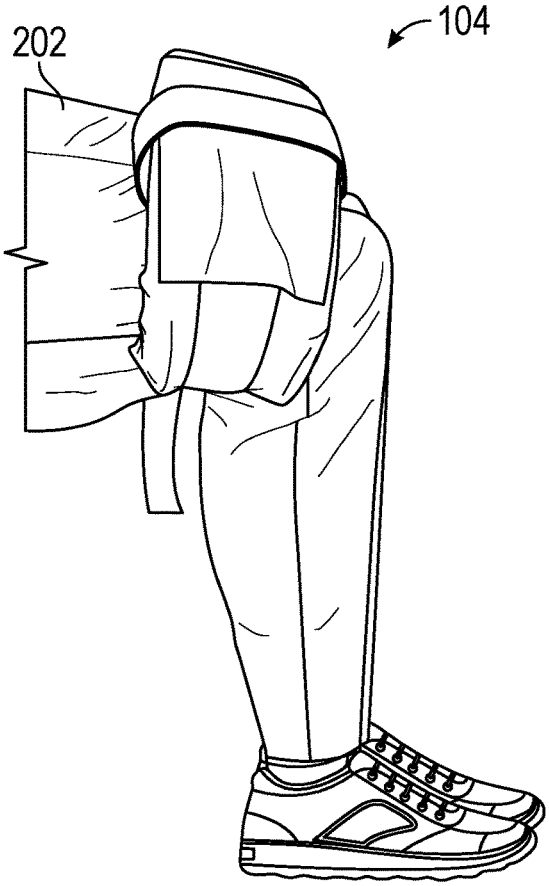
FIG. 8 illustrates a planar view of the convertible cushion system in operation.
Figure 9:
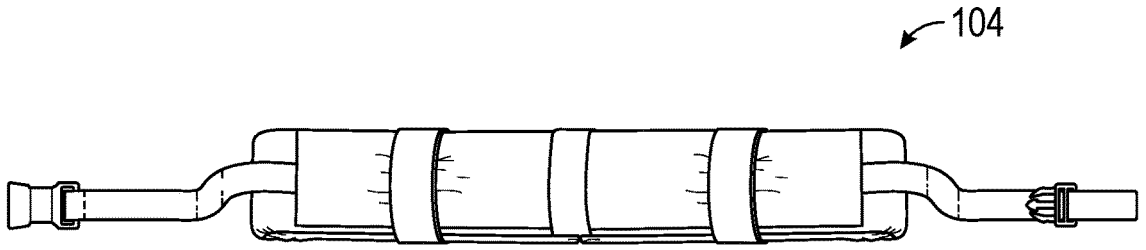
FIG. 9 illustrates a top view of the convertible cushion system in a folded arrangement.
Figure 10:
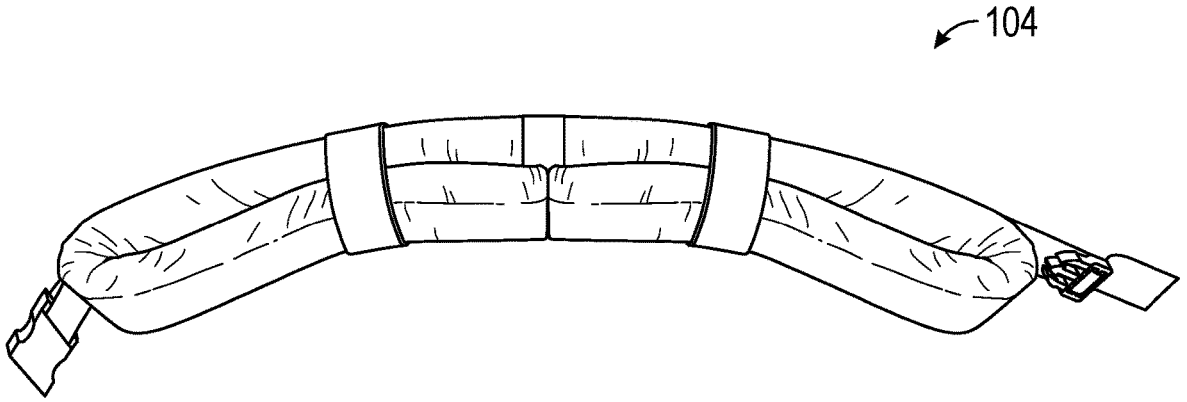
FIG. 10 illustrates a side view of the convertible cushion system in a folded arrangement.
Figure 11:
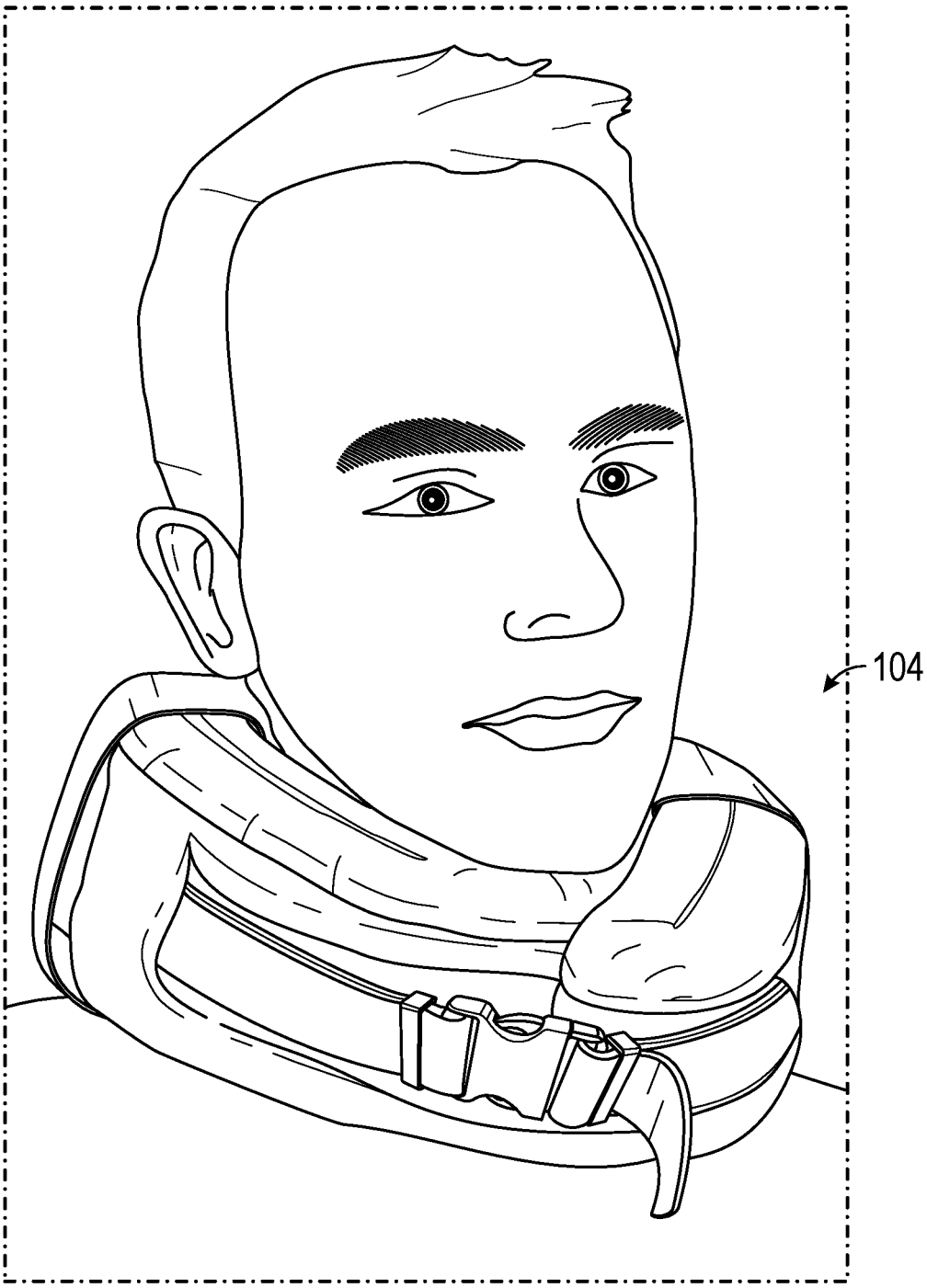
FIG. 11 illustrates a planar view of the convertible cushion system in an arrangement about a neck of a user.

FIG. 6 illustrates a bottom view of retaining portion 104 of convertible cushion system 100, with straps 402 shown in an open position to allow for adjusting the length of retaining cushion 105. FIGS. 7 and 8 illustrate planar views of retaining portion 104 of convertible cushion system 100 arranged about the legs 202 of a user. The pillow portion 102 is omitted, as shown by the space 714 between the legs 202 of user, and may be optionally used by a user in a different location. FIGS. 9 and 10 illustrate a top view and a side view of retaining portion 104 of convertible cushion system 100 in a folded arrangement. FIG. 11 illustrates a planar view of retaining portion 104 of convertible cushion system 100 in an arrangement about the neck of a user. The arrangement in FIG. 11 provides support for the head of a user. The convertible cushion system 100 may also be arranged about the head, such as around the forehead, of a user to provide comfort when resting.

Figure 12:
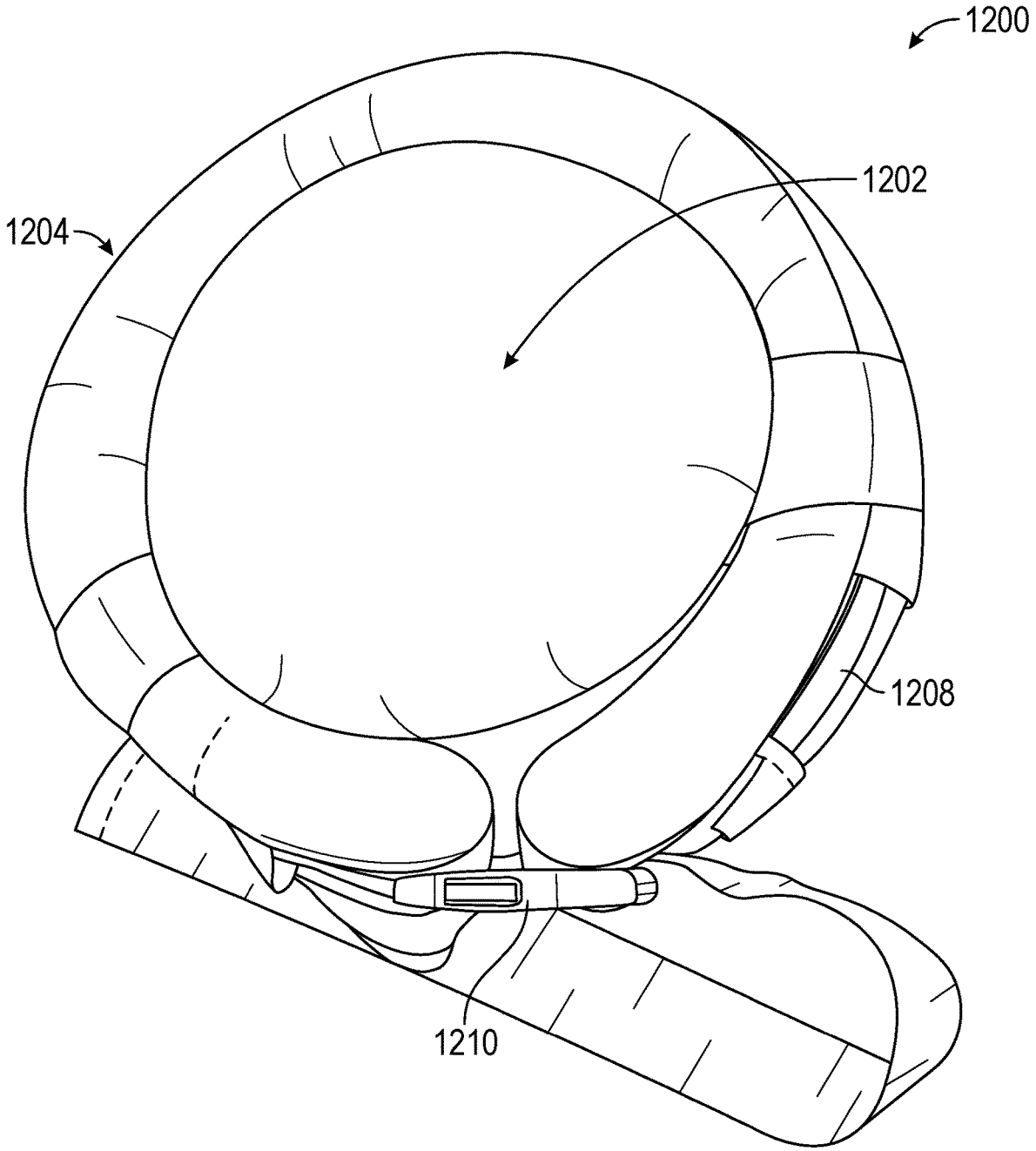
FIG. 12 illustrates a planar view of an embodiment of the convertible cushion system.
Figure 13:
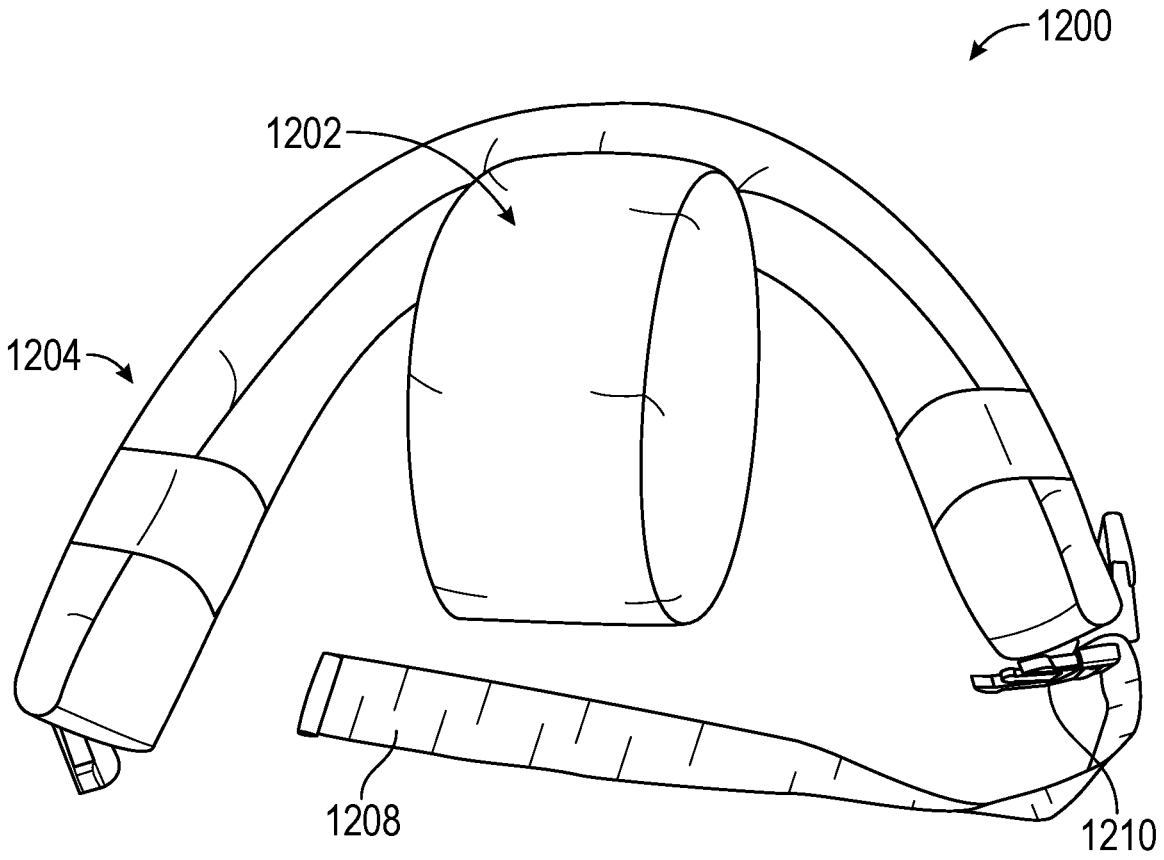
FIG. 13 illustrates a planar view of an embodiment of the convertible cushion system.

FIGS. 12 and 13 illustrate a various view of another embodiment of a convertible cushion system 1200 in accordance with the present disclosure. In FIG. 12, the convertible cushion system 1200 is shown in a compact arrangement that allows the convertible cushion system 1200 to be used as a head pillow to rest a head of a user while traveling. For example, if the traveler desires to nap on the floor at the airport, or perhaps while on the plane, the user may place the convertible cushion system 1200 on a tray table or other object to rest their head. The convertible cushion system 1200 in this compact arrangement allows it to be carried, stowed, or stored in a convenient place. The convertible cushion system 1200 includes a base pillow or pillow portion 1202 and a retaining cushion 1204.

In the illustrated embodiment, the pillow portion 1202 generally comprises a deformable, substantially cylindrical shaped pillow filled with a cushioning material (not shown) such as, for example, foam, a memory foam, woven materials, synthetic stuffing materials or organic stuffing materials.

The retaining cushion 1204 is arranged around the pillow portion 1202 such that the retaining cushion contacts the pillow portion 1202. The retaining cushion 1204 includes an adjustable strap 1208 that is adjustable in length. The retaining portion 1202 includes a connecting device 1210 that may include, for example, a buckle, hook and loop fasteners, or another suitable device or arrangement to connect and disconnect portions of the strap portion 1208. The connecting device may be used to adjust the length of the strap portion 1208 and to connect portions of the strap portion 1208 to form a substantially continuous loop. The connecting device 1210 may be opened or disconnected to disconnect the portions of the strap portion 1208.

FIG. 13 illustrates another view of the convertible cushion system 1200 arranged to be secured around the legs of a user. In this regard, the retaining cushion 1204 is configured to be arranged about the legs using strap portion 1208 secured by the connecting device 1210 to form a continuous loop around legs. The pillow portion 1202. as configured in FIG. 13, is oriented and arranged to be placed between legs such that pillow portion 1202 contacts the inner portion of legs. The pillow portion 1202 in the illustrated embodiment provides cushioning between the legs, and the retaining cushion 1204 impedes the legs from moving apart. The pillow portion 1202, while shown attached, is removably attached from the retaining cushion 1204 by, for example, hook and loop fasteners, snaps, or buttons.

Figure 14:
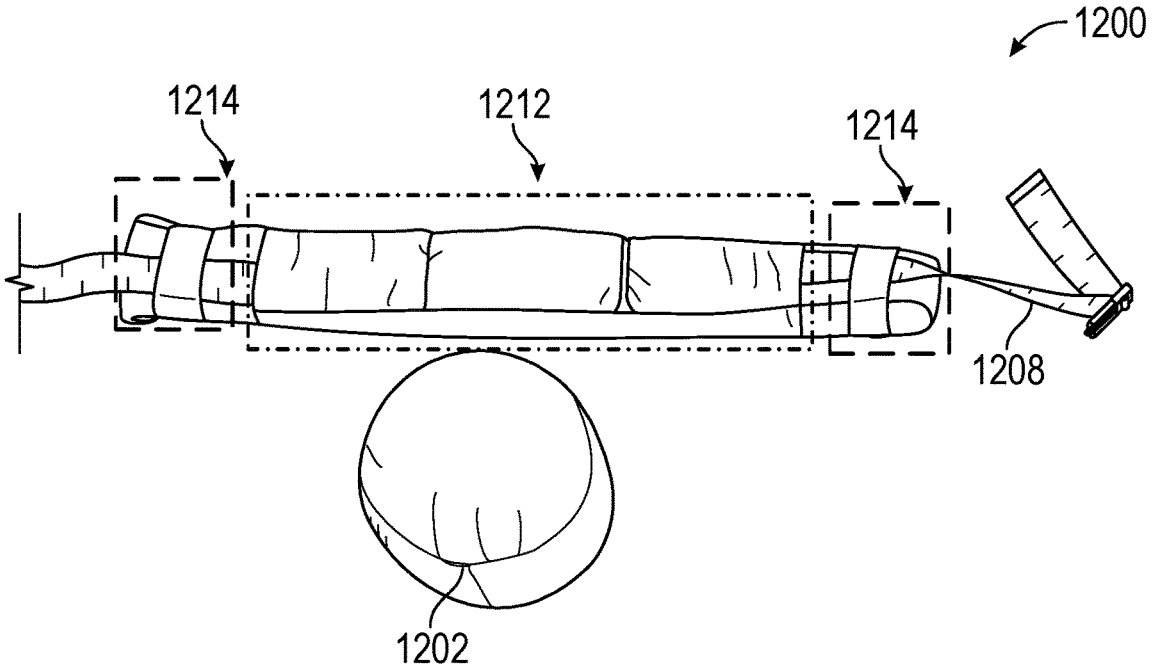
FIG. 14 illustrates a top view of an embodiment of the convertible cushion system.

FIG. 14 illustrates a top view of the convertible cushion system 1200 arranged in a separated position. In some embodiments, the outer face of retaining cushion 1204 may comprise at least one middle sleeve 1212. In further embodiments, the outer face retaining cushion 1204 may comprise a plurality of outer sleeves 1214. The plurality of sleeves may be used to assist in securing and/or guiding strap portion 1208 around retaining cushion 1204.

Figure 15:
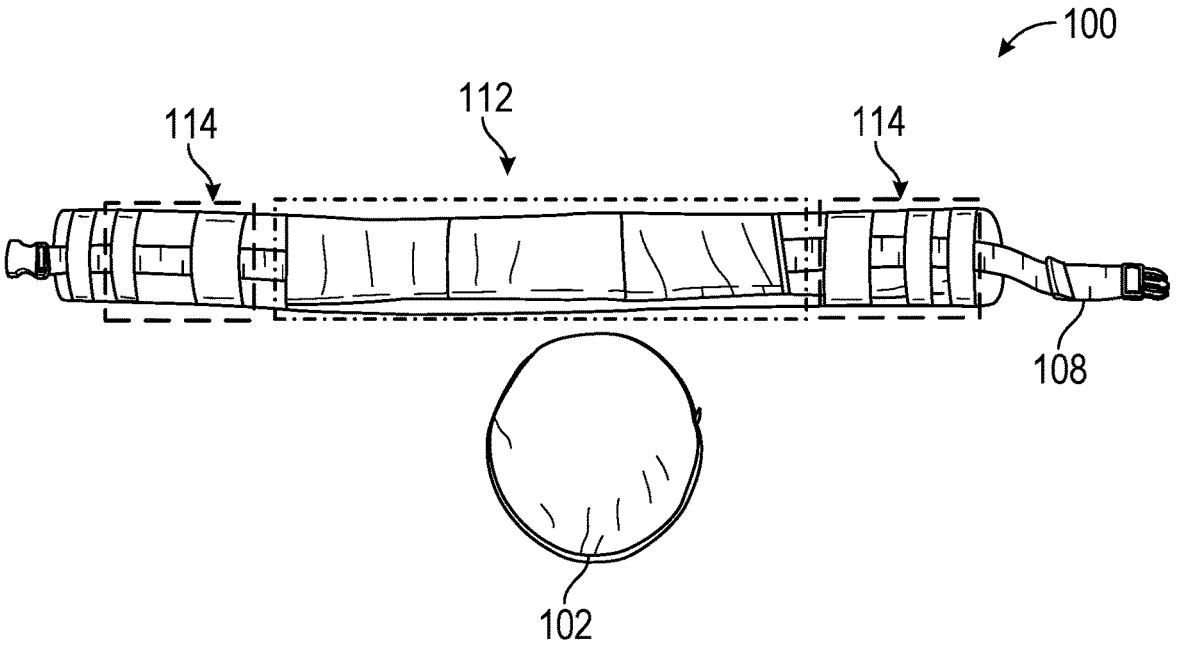
FIG. 15 illustrates a top view of an embodiment of the convertible cushion system.

FIG. 15 illustrates a top view of the convertible cushion system 100 arranged in a separated position. In some embodiments, the outer face of retaining cushion 105 may comprise at least one middle sleeve 112. In further embodiments, the outer face retaining cushion 105 may comprise a plurality of outer sleeves 114. The plurality of sleeves may be used to assist in securing and/or guiding strap portion 108 around retaining cushion 105.

Figure 16:
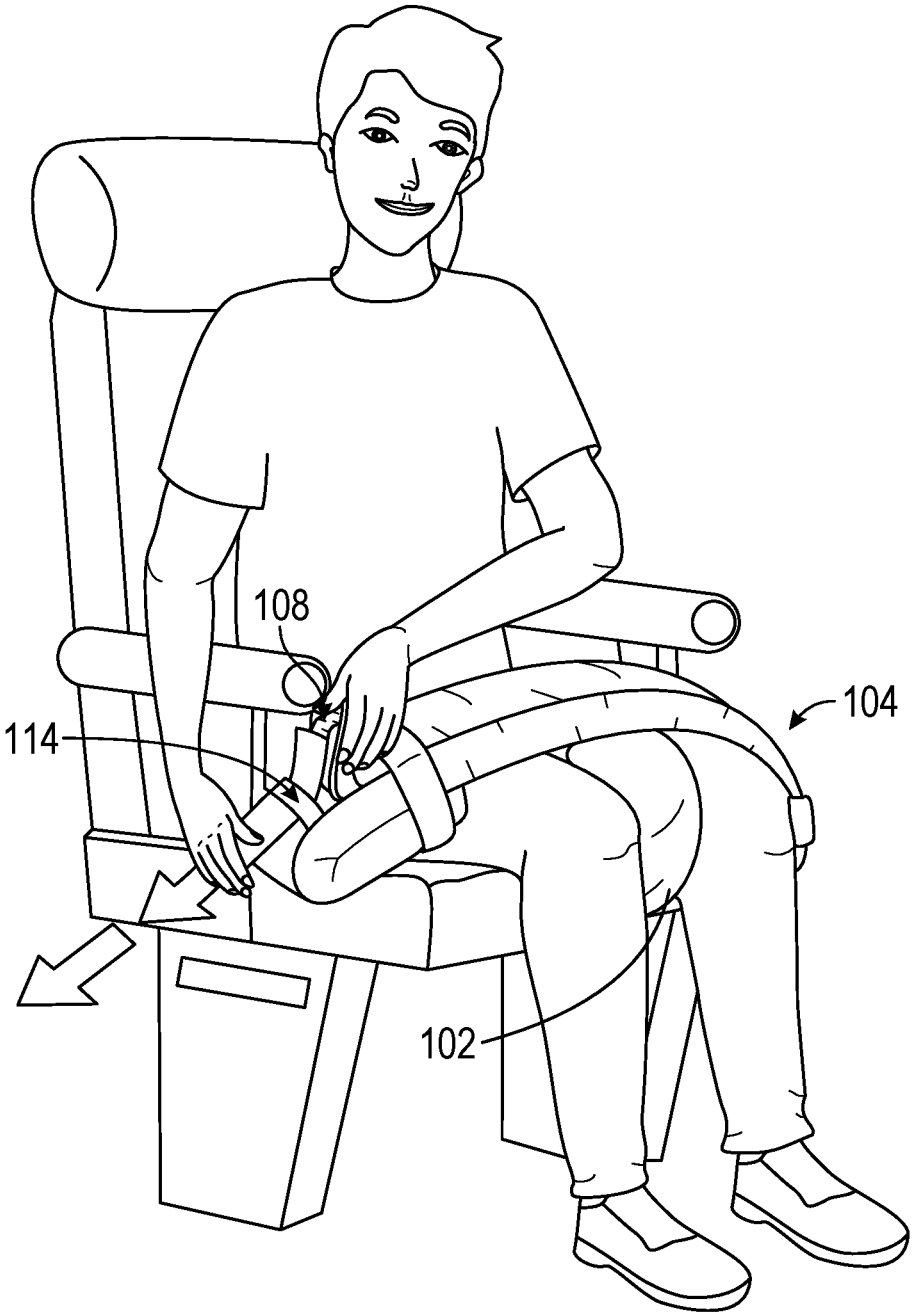
FIG. 16 illustrates a perspective view of an embodiment of the convertible cushion system.

FIG. 16 illustrates a perspective view of the convertible cushion system 100. FIG. 16 further illustrates strap portion 108 being guided through outer sleeve 114.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

ASPECTS

The present invention includes at least the following aspects:

Aspect 1: A convertible cushion system comprising: a pillow portion configured to detachably couple with a retaining portion in an assembled state, the pillow portion comprising: a base pillow portion including a top face, an opposed bottom face, and at least one side face connecting the top and bottom faces, the base pillow portion configured to releasably attach to a portion of the retaining portion; and the retaining portion comprising: a retaining cushion having first and second opposed ends and at least first and second opposed faces, an adjustable strap having first and second opposed ends, the adjustable strap disposed on the first face of the retaining cushion and configured to secure the retaining cushion around an object or user, and a connecting mechanism for detachably connecting portions of the adjustable strap to create a loop.

Aspect 2: A convertible cushion system comprising a pillow portion configured to detachably couple with a retaining portion in an assembled state, the pillow portion comprising: a base pillow portion including at least one face or surface, such as, for example, a top face or surface, an opposed bottom face or surface, and at least one side face or surface connecting the top and bottom, the base pillow portion configured to releasably attach to a portion of the retaining portion; and the retaining portion comprising: a retaining cushion having first and second opposed ends and at least first and second opposed faces, an adjustable strap having first and second opposed ends, the adjustable strap disposed on the first face of the retaining cushion and configured to secure the retaining cushion around an object or user, and a connecting mechanism for detachably connecting portions of the adjustable strap to create a loop.

Aspect 3: A convertible cushion system comprising: a base pillow portion configured to detachably couple with a retaining cushion in an assembled state, the base pillow portion including a top face, an opposed bottom face, and at least one side face connecting the top and bottom faces, the base pillow portion configured to releasably attach to a portion of the retaining cushion; and the retaining cushion having first and second opposed ends and at least first and second opposed faces, and comprising an adjustable strap having first and second opposed ends, the adjustable strap disposed on the first face of the retaining cushion and configured to secure the retaining cushion around an object or user, and a connecting mechanism for detachably connecting portions of the adjustable strap to create a loop.

Aspect 4: The convertible cushion system of any preceding aspect, wherein in the assembled state, the second face of the retaining cushion is configured to be coupled around substantially all of the at least one side face of the base pillow portion using the adjustable strap and connecting mechanism.

Aspect 5: The convertible cushion system of any preceding aspect, wherein the system further comprises a retaining state, wherein in the retaining state the retaining portion is configured to couple around legs of a user.

Aspect 6: The convertible cushion system of any preceding aspect, wherein in the retaining state the base pillow portion is configured to attach to the retaining portion at an orientation effective to allow the pillow to be placed between the user's legs while the retaining portion is coupled around the user's legs.

Aspect 7: The convertible cushion system of any preceding aspect, wherein in the retaining state the base pillow portion is configured to attach to the retaining portion at a substantially perpendicular orientation relative to the assembled state.

Aspect 8: The convertible cushion system of any preceding aspect, wherein in the retaining state the base pillow portion is configured to attach substantially orthogonal to the retaining portion.

Aspect 9: The convertible cushion system of any preceding aspect, wherein the retaining cushion comprises a folded arrangement configured to adjust a length or thickness of the retaining cushion, or a combination thereof.

Aspect 10: The convertible cushion system of any preceding aspect, wherein a length of the retaining cushion is configured to be adjusted by folding one or both ends towards an interior of the retaining cushion.

Aspect 11: The convertible cushion system of any preceding aspect, wherein a thickness of the retaining cushion is configured to be adjusted by folding one or both ends towards an interior of the retaining cushion.

Aspect 12: The convertible cushion system of any preceding aspect, the folded arrangement of the retaining cushion is maintained using one or more straps.

Aspect 13: The convertible cushion system of any preceding aspect, wherein the base pillow portion comprises a three-dimensional polygon.

Aspect 14: The convertible cushion system of any preceding aspect, wherein the base pillow portion comprises a substantially cylindrical shape.

Aspect 15: The convertible cushion system of any preceding aspect, further comprising an attachment mechanism configured for removably attaching pillow portion to the retaining portion in a plurality of orientations without the use of the adjustable strap or connecting mechanism.

Aspect 16: The convertible cushion system of any preceding aspect, wherein the pillow portion comprises an attachment mechanism configured to allow the base pillow portion to detachable attach to retaining cushion without the use of the adjustable strap or connecting mechanism.

Aspect 17: The convertible cushion system of any preceding aspect, wherein the attachment mechanism is configured to releasably attach the base pillow portion to a portion of the retaining portion.

Aspect 18: The convertible cushion system of any preceding aspect, wherein the attachment mechanism comprises cooperative attachment components on at least one surface the base pillow and retaining cushion, such as, for example, the side face of the base pillow portion and the bottom face of the retaining cushion.

Aspect 19: The convertible cushion system of any preceding aspect, wherein the retaining portion or retaining cushion comprises a neck supporting state configured to be secured around a neck of a user.

Aspect 20: The convertible cushion system any preceding aspect, wherein in the neck supporting state, one or more retaining straps are configured to secure the retaining cushion such that the retaining cushion provides a desired thickness and diameter to support a neck of the user.

Aspect 21: The convertible cushion system of any preceding aspect, wherein in the neck supporting state, the retaining cushion is configured to be secured around the neck of the user via the connecting device.

Aspect 22: A method for using a convertible cushion system, the method comprising: providing the convertible cushion system of any preceding aspect; and using the convertible cushion system in connection with a user.

Aspect 23: The method of any preceding aspect, wherein using comprises one or more of: converting the convertible cushion system from an assembled state to a retaining state; securing the retaining portion around the pillow portion via the strap portion and a connecting device; disconnecting the retaining portion from the pillow portion; arranging the pillow portion between legs of a user such that the top face and bottom face of the base pillow portion each contacts an inner portion of the legs; securing the retaining portion around the pillow portion such that the underside of retaining cushion connects with the side face of the base pillow portion; and connecting, via the connecting device, a first end of the strap portion to a second end of the strap portion to form a substantially continuous loop such that the legs of the user are secured in a desired position.

Aspect 24: The method or convertible cushion system of any preceding aspect, further comprising at least one securing mechanism, such as, for example, a band, belt, elastic strap or the like, for securing an object to or against the retaining portion or retaining cushion.

Aspect 25: The method or convertible cushion system of any preceding aspect, further comprising a securing mechanism for securing an object against or to a face or surface of the retaining portion or retaining cushion.

Aspect 26: The method or convertible cushion system of any preceding aspect, further comprising a securing mechanism for securing an object against or to a top and/or bottom face or surface of the retaining portion or retaining cushion.

Aspect 27: The method or convertible cushion system of any preceding aspect, wherein the securing mechanism comprises a band, belt, elastic strap or like element for securing a mobile device.

Aspect 28: The method or convertible cushion system of any preceding aspect, wherein the securing mechanism comprises a band, belt, elastic strap or like element for securing the at least one adjustable strap.

Aspect 29: The method or convertible cushion system of any preceding aspect, further comprising a plurality of securing mechanisms for securing first and second ends of the at least one adjustable strap.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Insofar as the description above and the accompanying drawings disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims.

The following is claimed:

1. A convertible cushion system comprising:

a pillow portion configured to detachably couple with a retaining portion in an assembled state, the pillow portion comprising a base pillow portion configured to releasably attach to a portion of the retaining portion; and the retaining portion comprising:

a retaining cushion having first and second opposed ends and at least first and second opposed faces, at least one adjustable strap having first and second opposed ends, the at least one adjustable strap disposed on the first face of the retaining cushion and configured to secure the retaining cushion around a user, and a connecting mechanism for detachably connecting portions of the at least one adjustable strap to create a loop, wherein the convertible cushion system is configured to convert from the assembled state to a retaining state, wherein in the retaining state, the base pillow portion is configured to attach to an underside of the retaining portion at an orientation effective to allow the base pillow portion to be held between the user's legs while the retaining portion is coupled around the user's legs.

2. The convertible cushion system of claim 1, wherein in the assembled state, the second face of the retaining cushion is configured to be coupled around substantially all of a side face of the base pillow portion using the at least one adjustable strap and the connecting mechanism.

3. The convertible cushion system of claim 2, wherein in the retaining state the retaining portion is configured to couple around at least one of the following:

legs of the user, a neck of the user, and a head of a user.

4. The convertible cushion system of claim 3, wherein in the retaining state the base pillow portion is configured to attach substantially orthogonal to the retaining portion.

5. The convertible cushion system of claim 3, wherein the retaining cushion is configured to convert between an unfolded arrangement and a folded arrangement, said folded arrangement configured to adjust a length or thickness of the retaining cushion, or a combination thereof, and wherein the length or of the retaining cushion is configured to be adjusted by folding one or both ends towards an interior of the retaining cushion.

6. The convertible cushion system of claim 3, further comprising an attachment mechanism configured for removably attaching the base pillow portion to the underside of the retaining portion in a plurality of orientations without the use of the at least one adjustable strap or the connecting mechanism.

7. The convertible cushion system of claim 6, further comprising at least one securing mechanism for securing an object to a face of the retaining cushion.

8. The convertible cushion system of claim 6, wherein the base pillow portion comprises a substantially cylindrical shape having a top face, an opposed bottom face, and a side face connecting the top face and the opposed bottom face.

9. The convertible cushion system of claim 6, wherein the retaining portion comprises a neck supporting state configured to be secured around the neck of the user via the connecting mechanism; and wherein in the neck supporting state, one or more retaining straps are configured to secure the retaining cushion such that the retaining cushion provides a desired thickness and diameter to support the neck of the user.

10. A method for using a convertible cushion system, the method comprising the steps of:

providing the convertible cushion system comprising:

a base pillow portion configured to detachably couple with a retaining cushion in an assembled state, the base pillow portion including at least one surface, the base pillow portion further configured to releasably attach to an underside of the retaining cushion using an attachment mechanism, and the retaining cushion having first and second opposed ends and first and second opposed faces, and comprising at least one adjustable strap having first and second opposed ends, the at least one adjustable strap disposed on the first face of the retaining cushion and configured to secure the retaining cushion around an object or user, and a connecting mechanism for detachably connecting ends of the at least one adjustable strap to create a continuous loop, wherein the convertible cushion system further comprises a retaining state and in the retaining state the retaining cushion is configured to couple around at least one of the following:

legs of the user, a neck of the user, and a head of a user; and using the convertible cushion system in connection with the user by converting from the assembled state to the retaining state, the retaining state being configured for the base pillow portion to attach to the underside of the retaining cushion using the attachment mechanism at an orientation effective to allow the base pillow portion to be held between the user's legs while the retaining cushion is coupled around the user's legs.

11. The method of claim 10, wherein using the convertible cushion system comprises one or more of:

arranging the base pillow portion between legs of the user such that an inner portion of the legs contacts the base pillow portion;

securing the retaining cushion around the base pillow portion such that the underside of retaining cushion connects with the base pillow portion; and connecting, via the connecting mechanism, the first end of the at least one adjustable strap to the second end of the at least one adjustable strap to form a substantially continuous loop such that the legs of the user are secured in a desired position.

12. The method of claim 11, wherein using the convertible cushion system further comprises converting the retaining state to the assembled state by coupling the retaining cushion around the base pillow portion using the at least one adjustable strap and the connecting mechanism.

13. A convertible cushion system comprising:

a base pillow portion configured to detachably couple with a retaining cushion in an assembled state, the base pillow portion including at least one surface, the base pillow portion further configured to releasably attach to an underside of the retaining cushion using an attachment mechanism; and the retaining cushion having first and second opposed ends and first and second opposed faces, and comprising at least one adjustable strap having first and second opposed ends, the at least one adjustable strap disposed on the first face of the retaining cushion and configured to secure the retaining cushion around a user, a securing mechanism for securing the at least one adjustable strap against the retaining cushion, and a connecting mechanism for detachably connecting ends of the at least one adjustable strap to create a continuous loop, wherein the attachment mechanism is configured for removably attaching the base pillow portion to the underside of the retaining cushion in a plurality of orientations, wherein the convertible cushion system is configured to convert from the assembled state to a retaining state, wherein in the retaining state the base pillow portion is configured to attach to the underside of the retaining cushion using the attachment mechanism at an orientation effective to allow the base pillow portion to be held between the user's legs while the retaining cushion is coupled around the user's legs.

14. The convertible cushion system of claim 13, wherein in the assembled state, the underside of the retaining cushion is configured to be coupled around the base pillow portion using the at least one adjustable strap and the connecting mechanism.

15. The convertible cushion system of claim 14, wherein in the retaining state the retaining cushion is configured to couple around at least one of the following: legs of a user, a neck of the user, and a head of a user.

16. The convertible cushion system of claim 15, wherein in the retaining state the base pillow portion is configured to attach substantially orthogonal to the retaining cushion.

17. The convertible cushion system of claim 16, further comprising at least one securing mechanism for securing an object to a first face of the retaining cushion.

18. The convertible cushion system of claim 16, wherein the base pillow portion comprises a foam material.

* * * * *